US008539871B1

(12) United States Patent
Burt et al.

(10) Patent No.: US 8,539,871 B1
(45) **Date of Patent: *Sep. 24, 2013**

(54) SELF-ENGAGING NON-RECIPROCATING CHARGING HANDLE

(71) Applicant: Magpul Industries Corp., Boulder, CO (US)

(72) Inventors: Eric C. Burt, Broomfield, CO (US); Brian L. Nakayama, Arvada, CO (US); Richard M. Fitzpatrick, Longmont, CO (US); Michael T. Mayberry, Denver, CO (US)

(73) Assignee: Magpul Industries Corp, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/675,531

(22) Filed: Nov. 13, 2012

Related U.S. Application Data

(63) Continuation of application No. 13/009,729, filed on Jan. 19, 2011, now Pat. No. 8,307,747.

(60) Provisional application No. 61/296,434, filed on Jan. 19, 2010.

(51) Int. Cl.
*F41A 9/00* (2006.01)
*F41A 35/00* (2006.01)

(52) U.S. Cl.
USPC ..... 89/1.4; 89/132; 42/14; 42/69.02

(58) Field of Classification Search
USPC ..... 89/1.4, 132, 138, 143, 191.01, 192, 89/179, 1.42; 42/69.02, 14, 16
See application file for complete search history.

(56) References Cited

U.S. PATENT DOCUMENTS

| | | | | |
|---|---|---|---|---|
| 3,377,730 | A | 4/1968 | Lewis | |
| 4,014,247 | A | 3/1977 | Tollinger | |
| 4,052,926 | A | 10/1977 | Tollinger | |
| 4,103,586 | A | 8/1978 | Tollinger | |
| 4,163,334 | A | 8/1979 | Tollinger | |
| 7,798,045 | B1 | 9/2010 | Fitzpatrick et al. | |
| 8,006,425 | B2 | 8/2011 | Burt et al. | |
| 8,261,649 | B2 | 9/2012 | Fitzpatrick et al. | |
| 2012/0042769 | A1 * | 2/2012 | Makayama et al. | 89/1.4 |

* cited by examiner

*Primary Examiner* — Michael David
(74) *Attorney, Agent, or Firm* — Geoffrey Dobbin; Dobbin IP Law P.C.

(57) ABSTRACT

A non-reciprocating, self-engaging charging handle is disclosed. It comprises a forward latch mounted upon a sliding body with a protruding handle. The latch positively engages the firearm's bolt carrier group when the handle is brought forward into contact therewith. A secondary latching system secures the charging handle to the upper receiver when not in use and disengages automatically when and only when a user desires to operate the handle. The charging handle's secondary latching system is also claimed as a stand-alone system.

4 Claims, 11 Drawing Sheets

SELF-ENGAGING NON-RECIPROCATING CHARGING HANDLE

CROSS-REFERENCES TO RELATED APPLICATIONS

This application claims priority as a continuation of U.S. application Ser. No. 13/009,729, filed Jan. 19, 2011, now U.S. Pat. No. 8,307,747, issued Nov. 13, 2012, which is in turn a non-provisional perfection of prior filed U.S. Provisional Application No. 61/296,434, filed Jan. 19, 2010, and incorporates the same herein by reference in their entirety.

FIELD OF THE INVENTION

The present invention relates to the field of firearms and more particularly relates to a non-reciprocating charging handle for automatic or semi-automatic firearms that will automatically engage the firearm's bolt carrier group when the handle is actuated so as to provide forward assist function.

BACKGROUND OF THE INVENTION

Modern repeating firearms utilize a bolt to engage and fire ammunition. The ignition of the ammunition not only fires the bullet, but also causes the bolt to recoil. Most firearms then utilize a system to return the bolt to a firing position, usually a mechanical return spring. Sometimes, however, the weapon may experience a minor malfunction, either in the feeding of ammunition or in the return system or some other malfunction, which causes the bolt to jam in a position that does not allow firing. To this end, early charging handles, which were essentially a part of the bolt carrier group itself and cycled with the bolt, were used to return the bolt to firing position. These reciprocating charging handles worked in both directions to retract and to act as a forward assist, closing the bolt with additional pressure beyond that of the return spring. However, these externally reciprocating parts could cause malfunctions or user injury if accidentally contacted during firing. Hence, non-reciprocating designs, in which the charging handle is separate and will selectively engage the bolt carrier, have become more popular. A significant drawback of the traditional non-reciprocating designs, such as for the M16, is that they initially lost the forward assist function inherent in a reciprocating charging handle. The charging handle engaged the bolt carrier group in one way only, to retract. These initial designs were later improved by adding an optional forward assist feature, usually connection between the charging handle and bolt carrier group that activated by a button or lever. The additional step of actuation can take time and is one point where user error may exacerbate a problem, especially if in the middle of a fire fight. When the weapon malfunctions, the user is not using it and the opponent is usually firing a weapon at the user and the user's comrades. Extended time repairing a problem is more risk to the entire team. What is needed is a non-reciprocating charging handle that eliminates the possibility of user error by automatically engaging the bolt carrier group when needed, both for retraction and forward assist.

The present invention is a non-reciprocating charging handle that will automatically engage the bolt carrier when it is deployed in a misfire or other situation. The present invention represents a departure from the prior art in that the charging handle of the present invention allows for selectable operation of the charging handle with automatic engagement of the same with the bolt carrier group of the firearm when such engagement is desired.

SUMMARY OF THE INVENTION

In view of the foregoing disadvantages inherent in the known types of charging handles, this invention provides a non-reciprocating, self-engaging charging handle. As such, the present invention's general purpose is to provide a new and improved charging handle that is automatic in its function in order to reduce user error while retaining safe operation.

To accomplish these objectives, the charging handle comprises a spring biased latch pivotally mounted on the charging handle body. The latch rests upon the barrel trunnion when not in use and a spur keeps the latch biased in a non-usable position. When the user desires use, the charging handle is pulled rearward so that the latch spur no longer engages the trunnion and the latch will then be biased in a usable position by the spring. The latch may then engage the bolt carrier group and secure it to the charging handle for manual manipulation of the bolt carrier group. Ideally, the charging handle also comprises a stowage latch which secures it to the upper receiver when not in use.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the charging is herein described. It should be noted that the articles "a", "an", and "the", as used in this specification, include plural referents unless the content clearly dictates otherwise.

Figure 3:
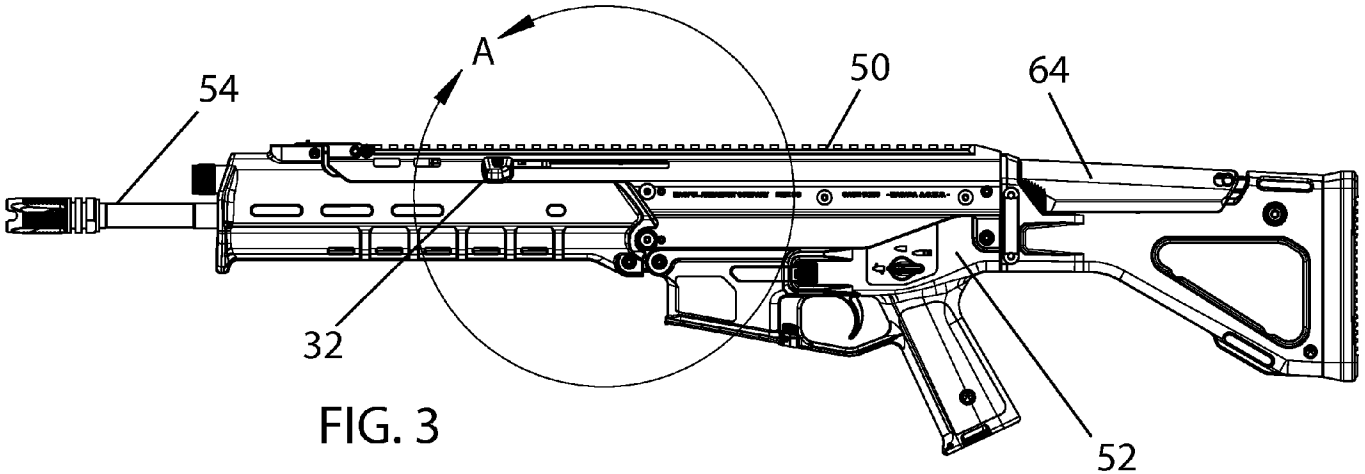
FIG. 3 is a left elevation of a firearm utilizing the charging handle of FIG. 1.
Figure 4:
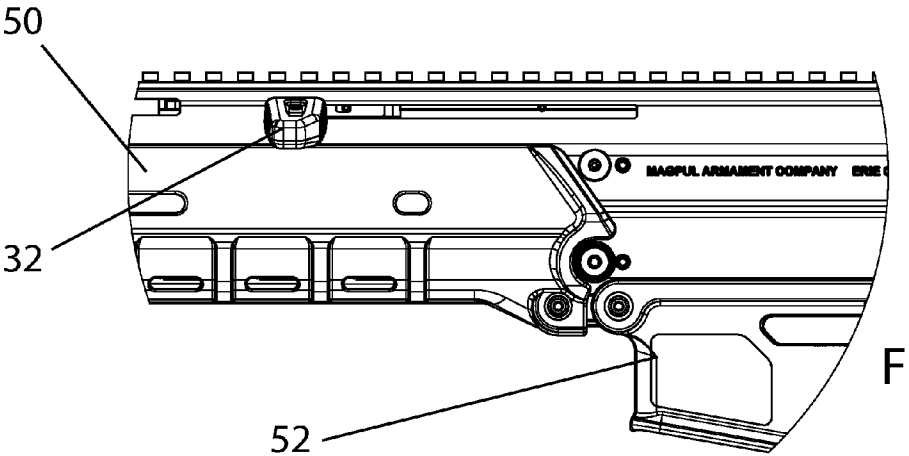
FIG. 4 is a close-up view of the firearm of FIG. 3, taken in circle A.
Figure 5:
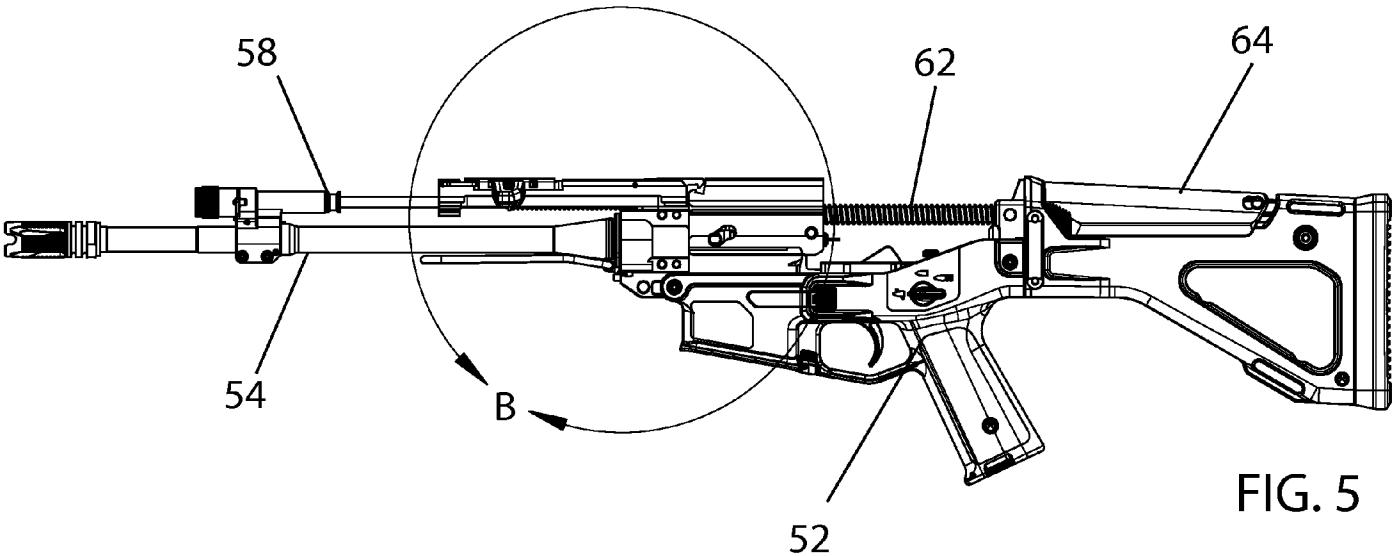
FIG. 5 is a left elevation of the firearm of FIG. 3, having the hand guard and upper receiver covering removed.
Figure 6:
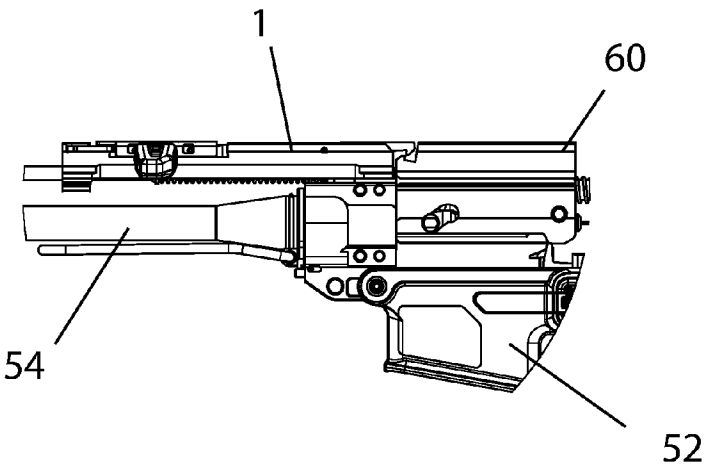
FIG. 6 is a close-up view of the firearm of FIG. 5, taken in circle B.

The charging handle 1 resides in a firearm, such that handle knob 32 projects outside the firearm upper receiver 50, FIGS. 3 and 4. In the given example firearm, it is positioned over the gas system 58, which is above and along the barrel 54 of the firearm, FIGS. 5 and 6. In the example firearm, the bolt carrier group 60 resides over the lower receiver 52 (including the grip, sear, hammer and trigger assembly) inside the upper receiver 50. A recoil spring 62 resides behind the bolt carrier group 60 and in front of the stock 54. It is to be understood that this exemplary firearm is depicted to show a possible environment only and is not intended to limit the invention to the firearm configuration shown alone. It is readily conceivable and should be understood that the charging handle of the present invention may be adapted to any known firearm and still fall within the purview of this specification and the appended claims.

Figure 1:
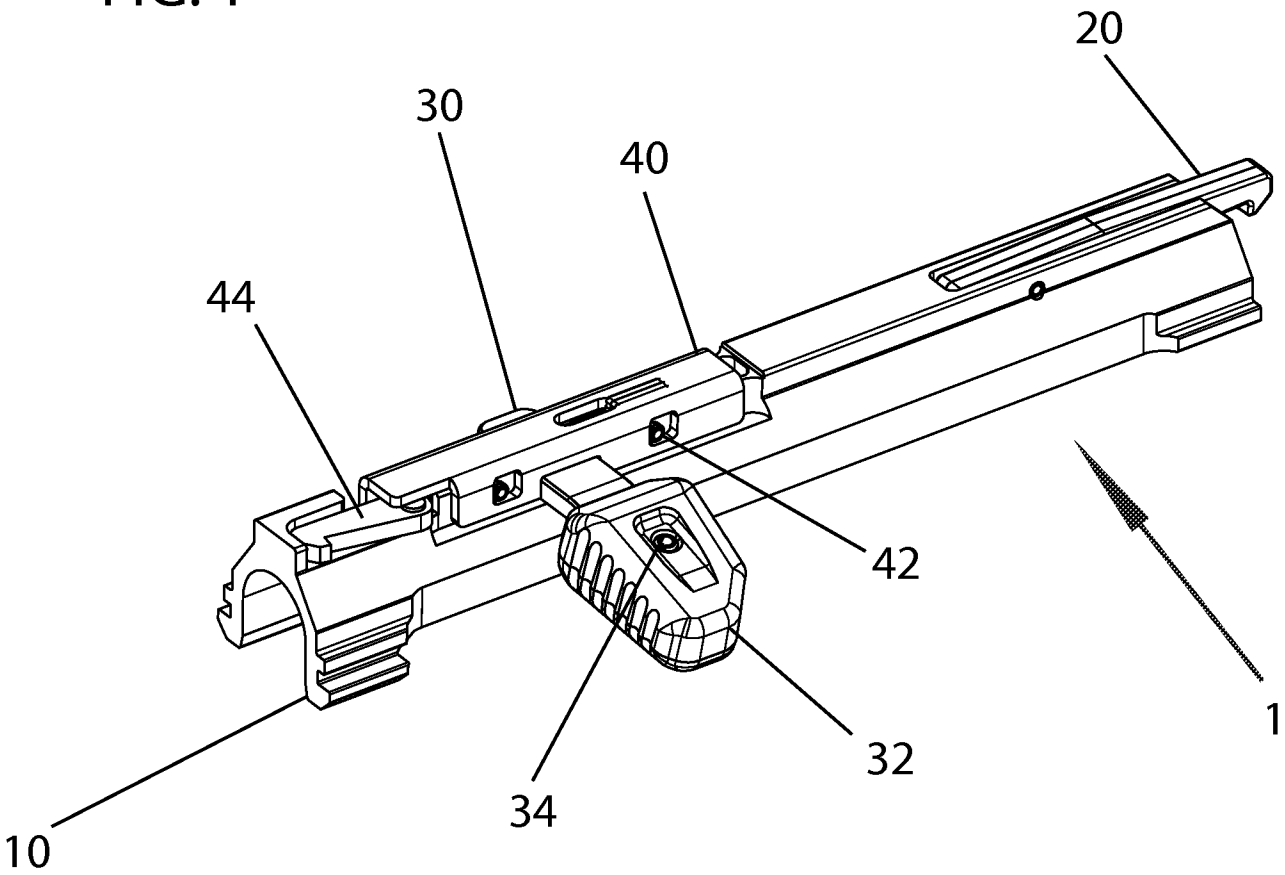
FIG. 1 is a perspective view of a charging handle according to the preferred embodiment of the present invention.
Figure 2:
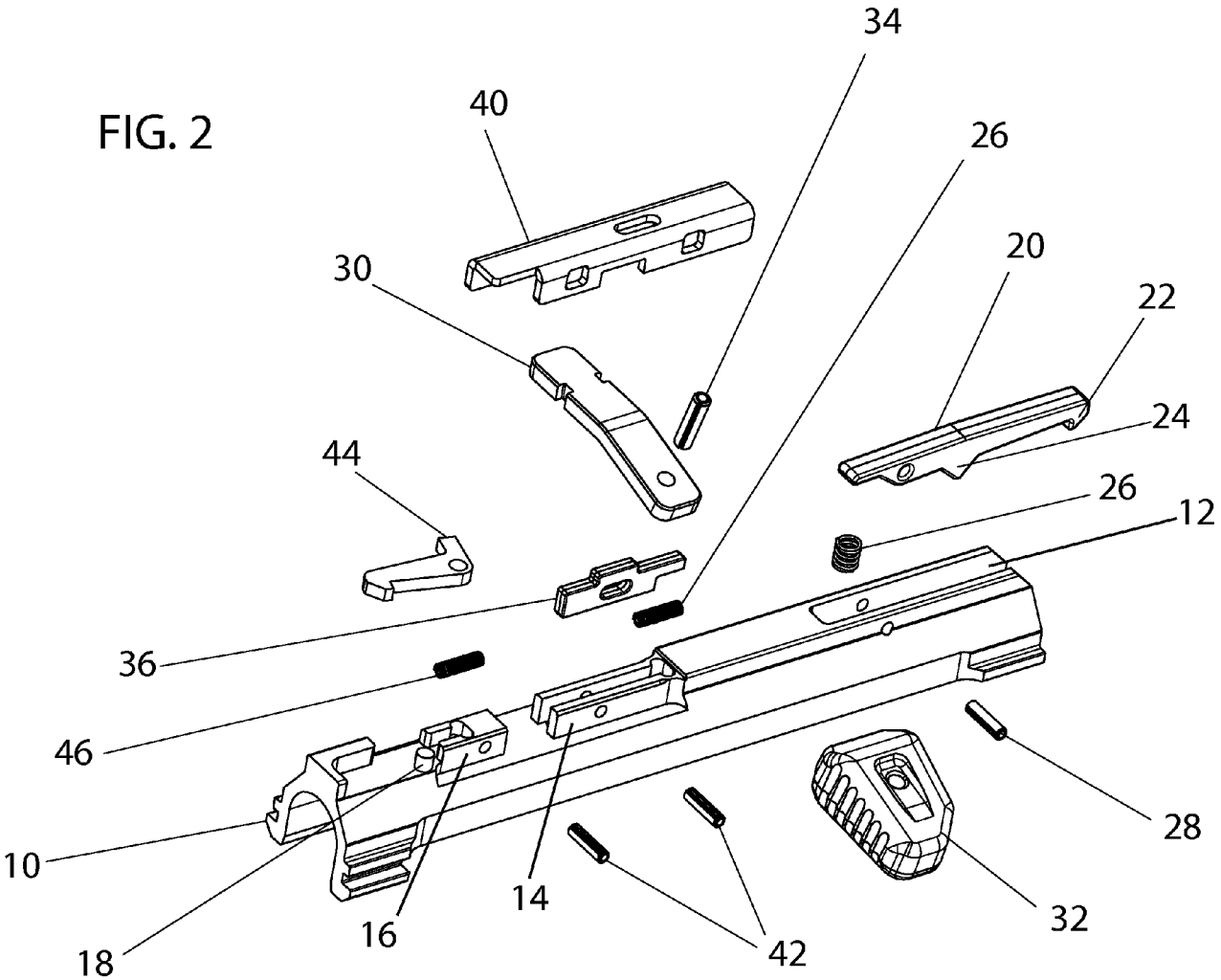
FIG. 2 is an exploded view of the charging handle of FIG. 1.
Figure 15:
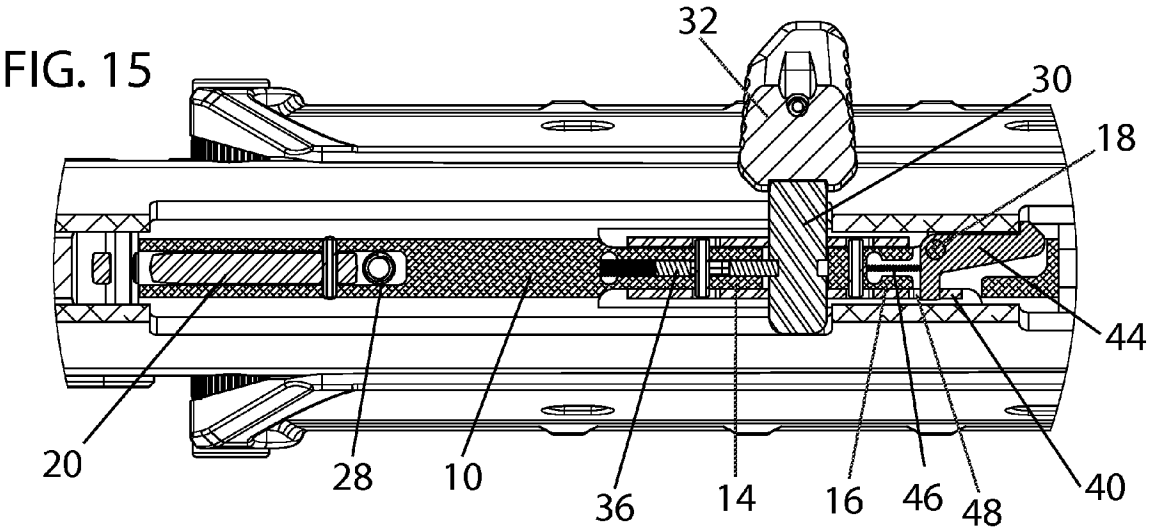
FIG. 15 is a close-up view of the firearm of FIG. 14, taken in circle F.
Figure 16:
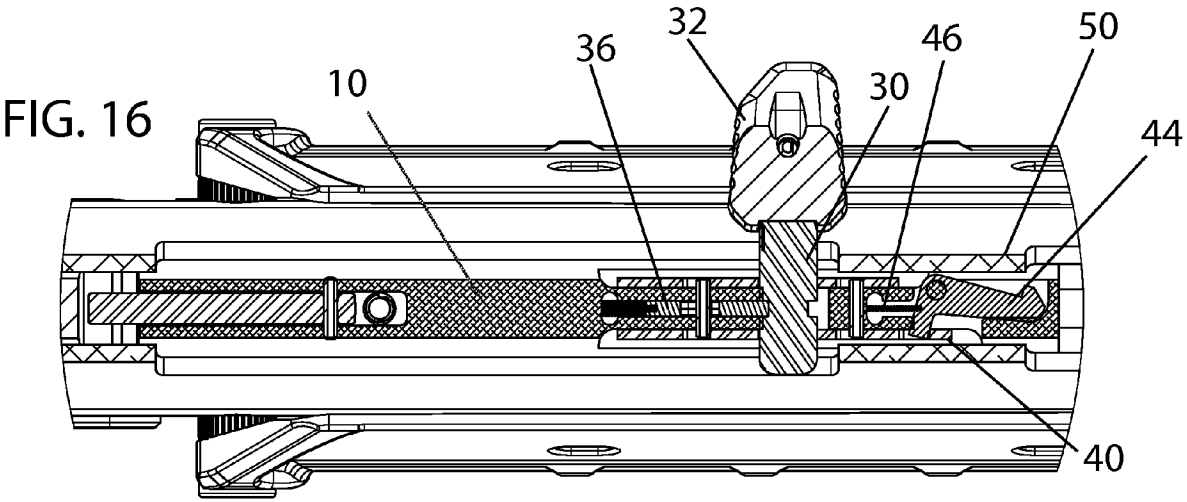
FIG. 16 is the firearm of FIG. 15, with the charging handle beginning to retract towards the bolt.

With reference to FIGS. 1 and 2, the charging handle 1 comprises an elongate handle body 1 with space reserved for other component parts, specifically a rearward trough 12 and two spring housings 14, 16 that are located on its top side. A bolt carrier latch 20 resides in trough 12 and is pivotally fixed in the body 10 by a spring pin 28. Latch spring 26 is stationed in the trough 12 and biases bolt carrier latch 20 in a downward orientation. A second, L-shaped stowage latch 44 resides toward a forward end of the body 10 and is biased toward the left side by spring 46 that is housed in a forward spring housing 16. It pivots about a post 18 formed in the body 10 just in front of the forward spring housing 16. A handle blade 30, with an associated handle knob 32 secured by spring pin 34, resides in a middle portion of the body 10 between the spring housings with sufficient space to allow motion along the length of the charging handle body 10. It abuts handle follower 36 which is spring biased forward by a handle spring 38 that is positioned in a rear spring housing 18. An actuator slide 40 is positioned over the handle blade 30 and handle follower 36 and secured to the body 10 by spring pins 42 inserted through the spring housings. The actuator slide 40 also interfaces with the stowage latch 44 as a tail of the stowage latch 44 is threaded through a port 48 in the actuator slide 40 (see FIGS. 15 and 16). Actuator slide 40 is movable along a longitudinal axis of the body 10 as the holes through which spring pins 42 secure the actuator slide 40 to the body 10 are oblong, as is a hole in the handle follower 36 through which the rear spring pin 42 passes. The handle blade 30 projects through a slot on the side of the actuator slide 40 and the handle follower 36 also has a slight projection that interfaces with a slot on an upper side of the actuator slide 40. While both the handle blade 30 and stowage latch 44 are depicted as projecting to the left of the charging handle 1, one or the other may project towards the right and the handle blade 30 may project in both directions.

Figure 7:
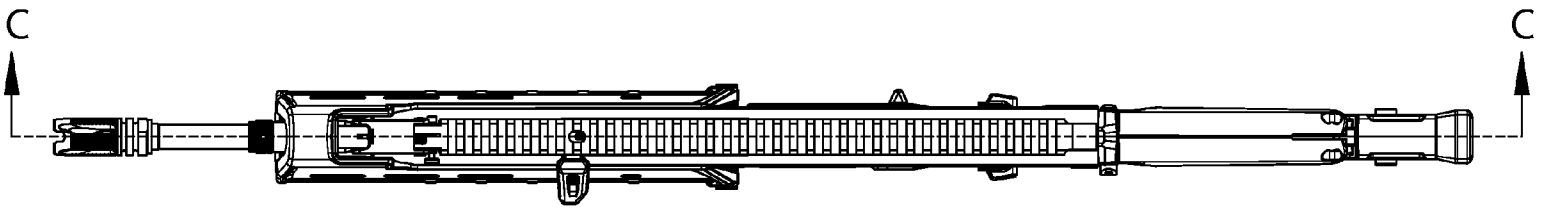
FIG. 7 is a top plan view of the firearm of FIG. 3, with the bolt in a mid-stoke position.
Figure 8:
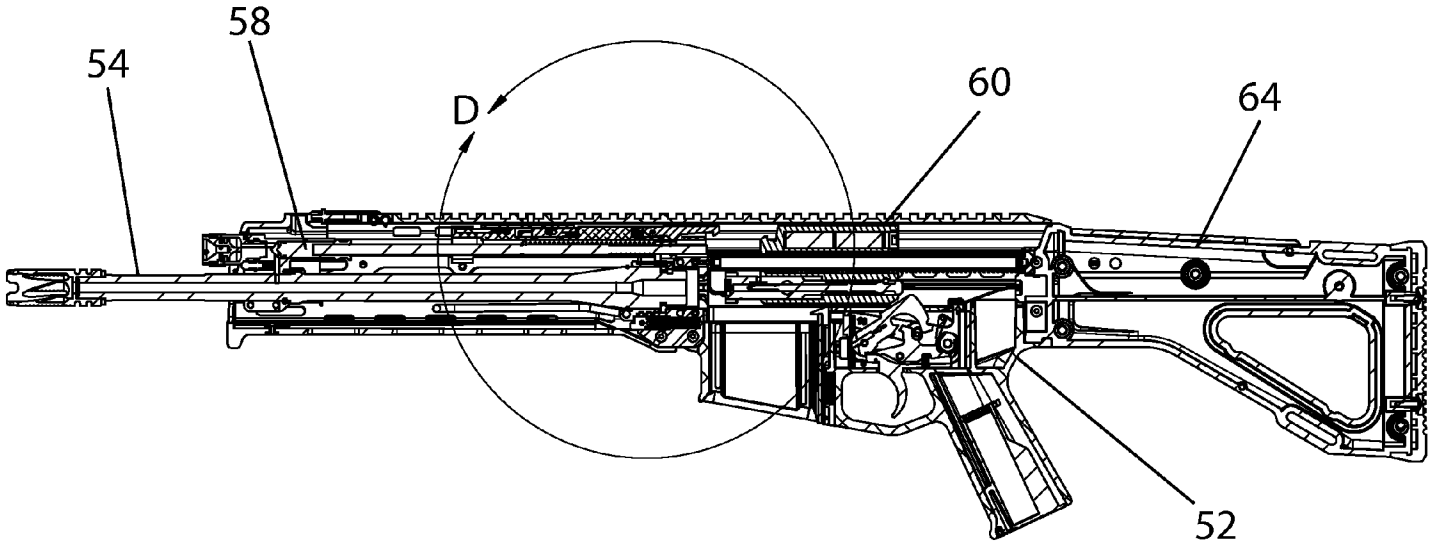
FIG. 8 is a sectional view of the firearm of FIG. 7, taken along line C-C.
Figure 9:
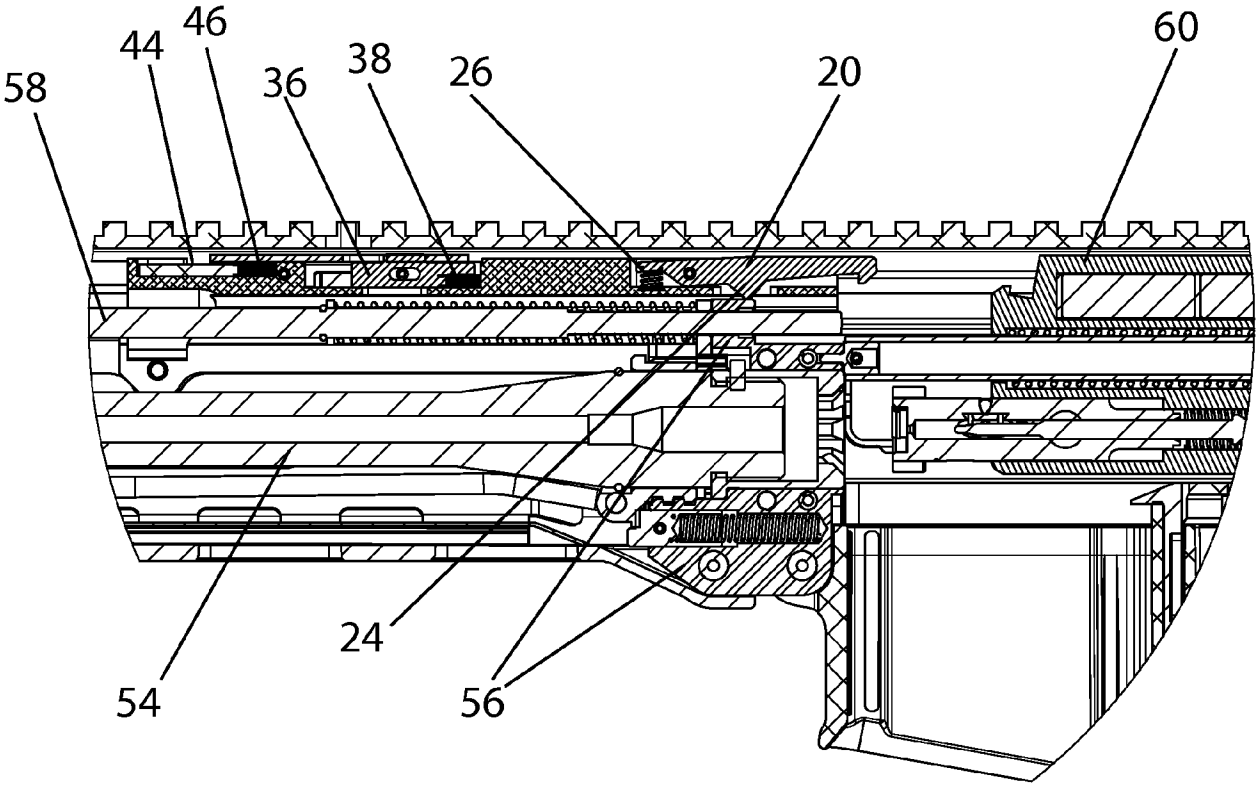
FIG. 9 is a close up view of the firearm of FIG. 8, taken in circle D.
Figure 10:
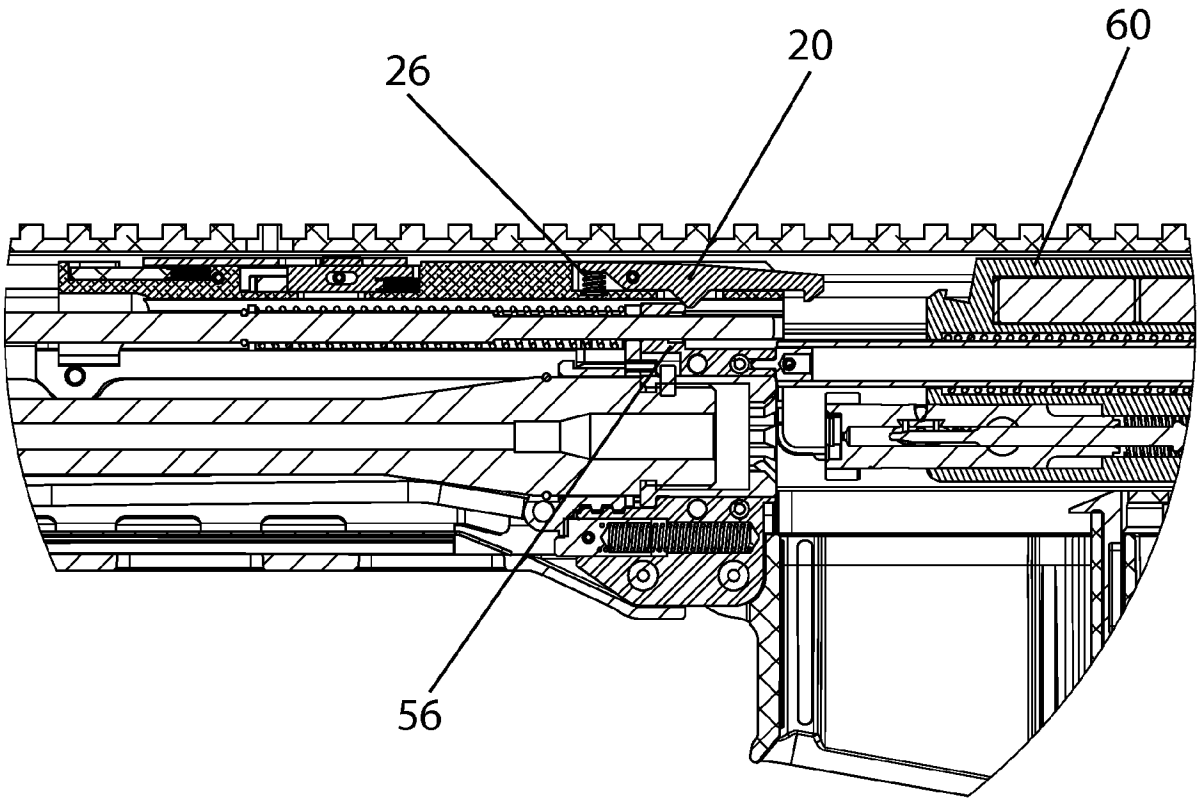
FIG. 10 the firearm in the same view as FIG. 8, with the charging handle of FIG. 1 beginning to retract towards the bolt.
Figure 11:
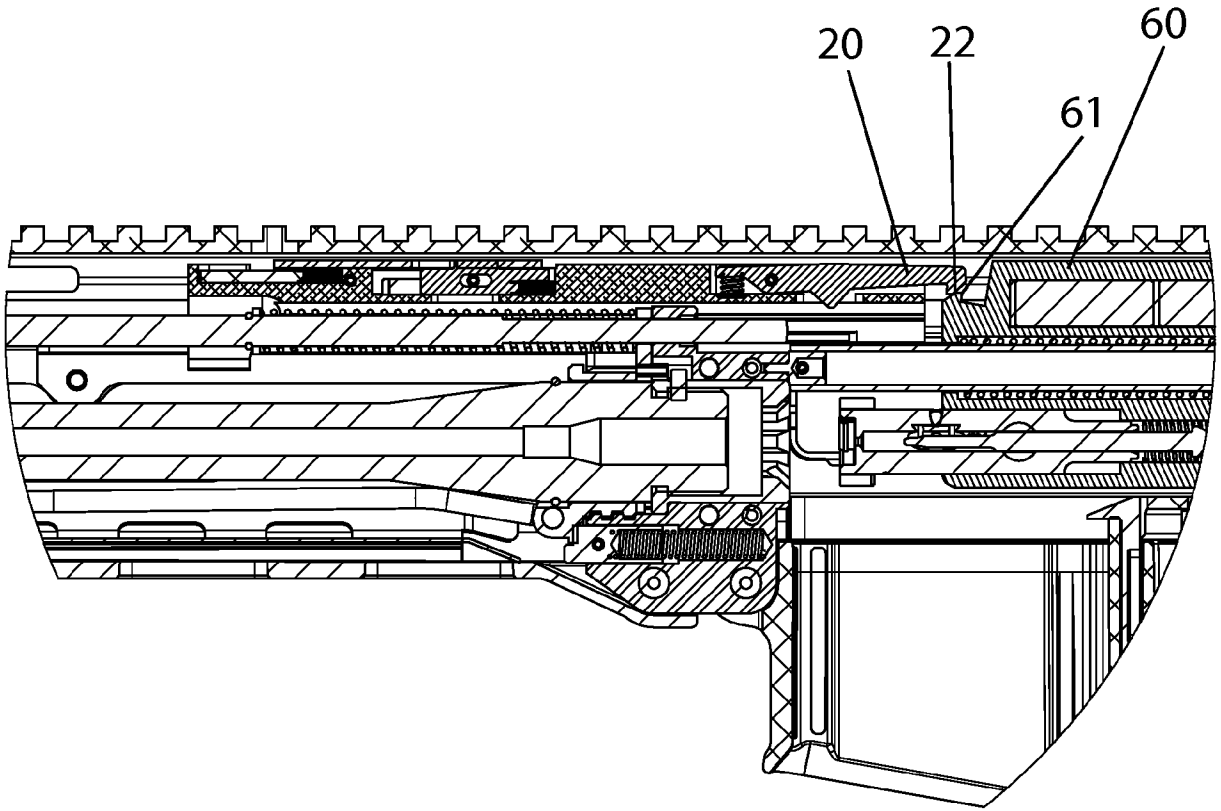
FIG. 11 is the firearm in the same view as FIG. 8, with the charging handle about to engage the bolt.
Figure 12:
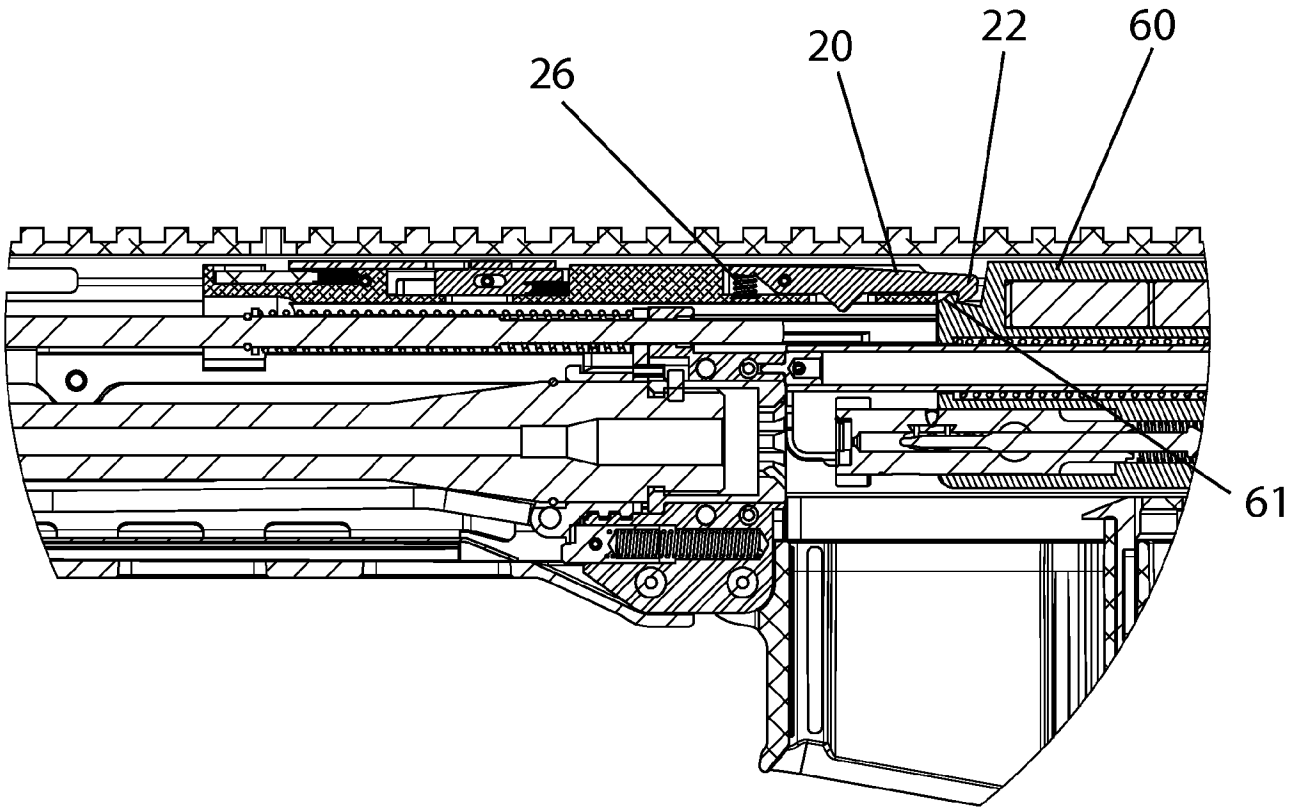
FIG. 12 is the firearm in the same view as FIG. 8, with the charging handle engaging the bolt.
Figure 13:
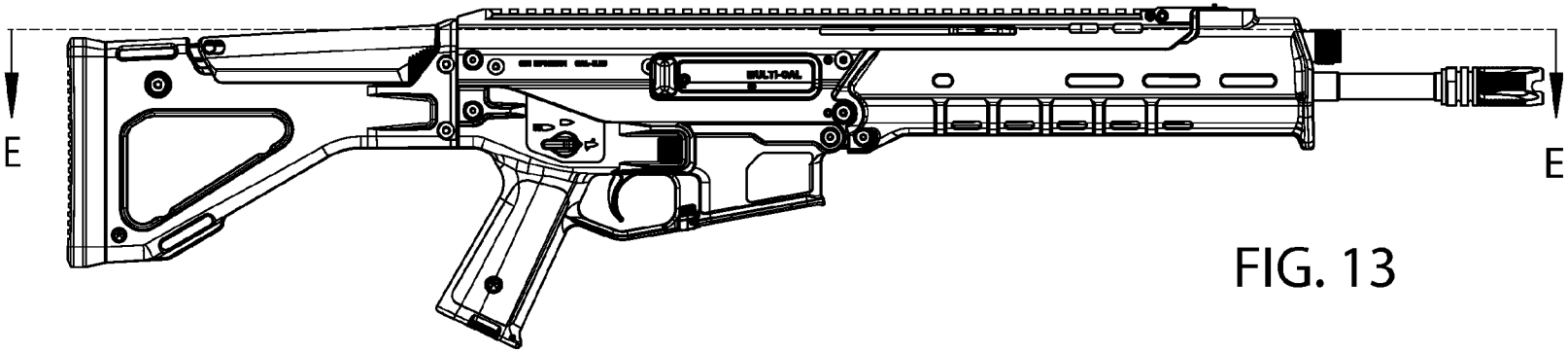
FIG. 13 is a right elevation of the firearm of FIG. 3.
Figure 14:
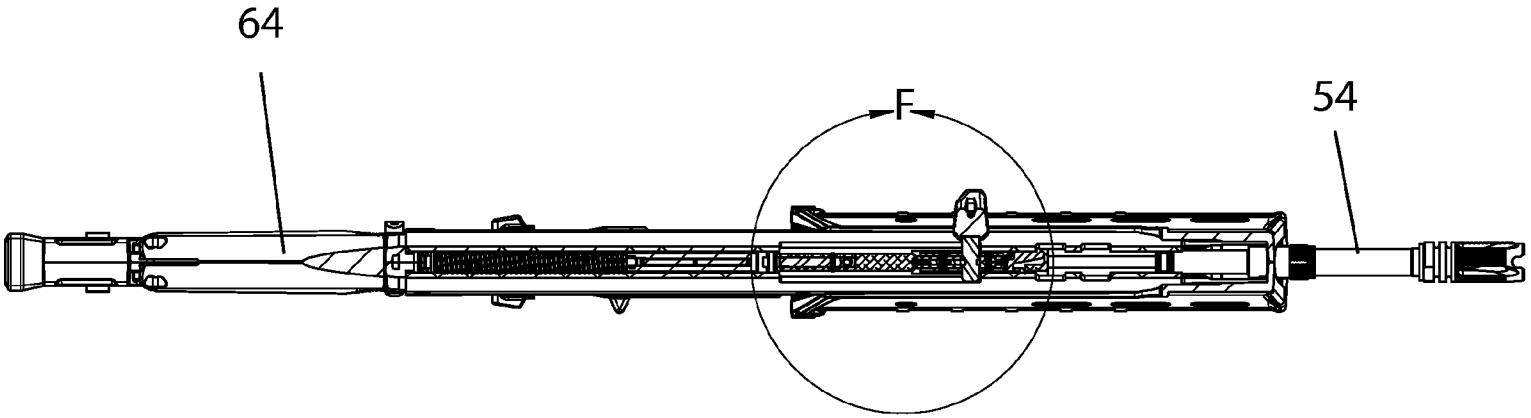
FIG. 14 is a sectional view of the firearm of FIG. 13, taken along line E-E.

Use of the charging handle 1 is depicted in FIGS. 7-12. When stowed, as shown in FIGS. 7-9, the charging handle 1 resides over the gas system 58, with a ventral spur 24 of the bolt carrier latch 20 resting on the barrel trunnion 56 of the firearm. This then biases the bolt carrier latch 20 against the latch spring 26 and holds the hook end 22 of the bolt carrier latch 20 upwards in a manner so as to not interact with the bolt carrier group 60 during normal firing situations. When a user begins to retract the charging handle 1, the spur 24 is moved off of the trunnion 56 and the bolt carrier latch 20 is biased by latch spring 26 in a downward position (FIG. 10) such that the hook 22 is ready to engage the bolt carrier group 60. Once contact is made (FIG. 11), the bolt carrier latch 20 is again biased against the latch spring 26 as it is pushed upwards by a lip 61 on the bolt carrier group 60. Final engagement (FIG. 12) is made when the latch hook 22 passes the lip 61 and is again biased downward by latch spring 26, securing the lip of the bolt carrier group 60 and enabling manual movement of the bolt.

Being a non-reciprocating handle, the charging handle 12 is secured inside the upper receiver 50 by the stowage latch 44, which is biased outward towards a side of the body 10 (shown as the left in the figures, though it is conceivable that the stowage latch 44 could be biased toward the right). As shown in FIGS. 13-16, the stowage latch 44 engages the upper receiver 50 when the charging handle 1 is not in use. During initial movement of the handle (FIG. 16), the handle blade 30 pushes the handle follower 36 and the associated actuator slide 40 rearward. This then causes the actuator slide 40 to pull on the tail of the stowage latch 44 and rotate it away from the upper receiver 50, disengaging it and the charging handle 1 from the upper receiver 50 and allowing the above discussed motion.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A non-reciprocating charging handle comprising:

a. an elongate handle body defining a longitudinal axis and having forward and rearward ends, a top side with a containment trough, and an orifice within the trough;

b. an engagement latch, further comprising a hook end and a ventral spur, pivotably mounted within the trough in the top side of the handle body, along the longitudinal axis such that the hook end is positioned beyond the rearward end of the handle body; and c. a handle blade projecting to at least one side of the charging handle;

wherein, when the charging handle is non-operative, the ventral spur passes through the orifice in the handle body and engages a barrel trunnion so as to bias the engagement latch upwards and, when the charging handle is operative, the ventral spur disengages from said barrel trunnion, allowing the engagement latch to drop into an operative position.

2. The non-reciprocating handle of claim 1, further comprising a secondary latch, located near the forward end of the charging handle, pivotably mounted and spring biased to interface with a receiver of a firearm when the charging handle is non-operative and in operable communication with the handle blade such that movement of the handle blade counteracts the spring bias and releases engagement of the secondary latch from the receiver.

3. A non-reciprocating charging handle comprising:

a. An elongate charging handle base, defining a top side, a longitudinal axis, and having forward and rearward ends, said charging handle base further comprising a rearward trough with a centrally located hole, said trough extending to the rearward end of the charging handle base and two spring housings located on the top side;

b. An engagement latch further comprising a latch hook and a ventral spur, the engagement latch pivotably mounted within the rearward trough such that the ventral spur may pass through the centrally located hole and the latch hook extends beyond the rearward end of the charging handle base;

c. A handle positioned between the two spring housings;

d. A handle follower abutting the handle and at least partially residing in one of the spring housings;

e. A first biasing spring located in the same spring housing as the handle follower, abutting the same and biasing the handle follower and handle away from the spring housing;

f. A securement latch located at a mouth of the remaining spring housing, pivotably mounted to allow for motion;

g. A second biasing spring, residing in the remaining spring housing and biasing the securement latch in a manner to pivot the securement latch away from the longitudinal axis; and h. An actuator slide, at least partially covering the spring housings, handle and securement latch and capable of some motion along the longitudinal axis, the actuator slide interfacing with the securement latch in a manner to counteract the bias caused by the second biasing spring when the actuator slide is moved in a direction and is biased in an opposite direction by the handle and the first biasing spring.

4. A latching handle assembly for a device with an elongate body with a longitudinal axis which slidably engages an environment structure, the handle comprising:

a. A handle positioned between two spring housings on a top side of the elongate body;

b. A handle follower abutting the handle and at least partially residing in one of the spring housings;

c. A first biasing spring located in the same spring housing as the handle follower, abutting the same and biasing the handle follower and handle away from the spring housing;

d. A securement latch located at a mouth of the remaining spring housing, pivotably mounted to allow for motion;

e. A second biasing spring, residing in the remaining spring housing and biasing the securement latch in a manner to pivot the securement latch away from a longitudinal axis; and f. An actuator slide, at least partially covering the spring housings, handle and securement latch and capable of some motion along the longitudinal axis, the actuator slide interfacing with the securement latch in a manner to counteract the bias caused by the second biasing spring when the actuator slide is moved in a direction and is biased in an opposite direction by the handle and the first biasing spring.

* * * * *